US007042321B2

(12) United States Patent
Walraet

(10) Patent No.: US 7,042,321 B2
(45) Date of Patent: May 9, 2006

(54) ELECTROMAGNETIC ACTUATOR WITH CONTROLLED ATTRACTION FORCE

(75) Inventor: David Walraet, Saint-Germain en Laye (FR)

(73) Assignee: Valeo Systems de Controle Moteur, Osny (FR)

( * ) Notice: Subject to any disclaimer, the term of this patent is extended or adjusted under 35 U.S.C. 154(b) by 0 days.

(21) Appl. No.: 10/504,740

(22) PCT Filed: Feb. 28, 2003

(86) PCT No.: PCT/FR03/00658

§ 371 (c)(1),
(2), (4) Date: Aug. 16, 2004

(87) PCT Pub. No.: WO03/075293

PCT Pub. Date: Sep. 12, 2003

(65) Prior Publication Data

US 2005/0083159 A1 Apr. 21, 2005

(30) Foreign Application Priority Data

Mar. 1, 2002 (FR) ..... 02 02631

(51) Int. Cl.
*H01F 7/00* (2006.01)

(52) U.S. Cl. ..... 335/220; 335/261; 335/236

(58) Field of Classification Search ..... 335/256, 335/270–273, 220–234, 236, 261–262; 251/129.1–19; 123/90.11
See application file for complete search history.

(56) References Cited

U.S. PATENT DOCUMENTS 4,455,497 A 6/1984 Shtrikman
5,207,239 A 5/1993 Schwitalla
5,515,818 A 5/1996 Born
5,548,263 A 8/1996 Bulgatz et al.

(Continued)

FOREIGN PATENT DOCUMENTS

DE 199 13 050 A1 9/2000

(Continued)

OTHER PUBLICATIONS

International Search Report for PCT/FR03/00658 issued Jul. 9, 2003.

*Primary Examiner*—Lincoln Donovan
(74) *Attorney, Agent, or Firm*—Foley & Lardner LLP

(57) ABSTRACT

The invention relates to an electromagnetic actuator comprising an actuator member (6) connected to an armature (8) which is movable under drive from a drive member comprising at least one coil (1) for generating magnetic flux in a core (2) having a face facing a face of the armature (8), at least one of the facing faces including at least one set-back portion (10), the armature (8) and the core (2) being arranged, in a first zone (12) of the armature (8) and of the core (2) including the set-back portion, to define a first magnetic path which is interrupted by an air gap that is not less than the setback of the set-back portion (10) when the armature (8) bears against the core (2), and in a second zone (13) of the armature (8) and of the core (2) excluding the set-back portion, to define a second magnetic path which is interrupted solely by a residual air gap when the armature (8) bears against the core (2), the total area of the set-back portion being no greater than an area that would bring the magnetic flux to saturation in the second zone of the armature.

40 Claims, 2 Drawing Sheets

U.S. PATENT DOCUMENTS

| | | | | |
|---|---|---|---|---|
| 5,636,601 | A | 6/1997 | Moriya et al. | |
| 5,690,064 | A | 11/1997 | Izuo | |
| 5,730,091 | A | 3/1998 | Diehl et al. | |
| 5,799,926 | A | 9/1998 | Moriya et al. | |
| 5,868,108 | A | 2/1999 | Schmitz et al. | |
| 5,961,097 | A | 10/1999 | Zimmermann | |
| 6,078,235 | A | 6/2000 | Schebitz et al. | |
| 6,215,299 | B1 | 4/2001 | Reynolds et al. | |
| 6,276,317 | B1 * | 8/2001 | Yoeda et al. | 123/90.11 |
| 6,390,036 | B1 * | 5/2002 | Yuuki | 123/90.11 |
| 6,397,798 | B1 | 6/2002 | Fiaccabrino | |

FOREIGN PATENT DOCUMENTS

| | | |
|---|---|---|
| EP | 1 132 581 B1 | 9/2001 |
| FR | 579.885 | 10/1924 |
| FR | 1.109.598 | 1/1956 |
| FR | 2 808 375 A1 | 11/2001 |
| JP | 10-332027 | 12/1998 |
| WO | WO 98/33194 A1 | 7/1998 |

* cited by examiner

ELECTROMAGNETIC ACTUATOR WITH CONTROLLED ATTRACTION FORCE

CROSS-REFERENCE TO RELATED APPLICATIONS

This application is a National Stage of Application PCT/FR03/00658, filed Feb. 28, 2003, which claims priority to French patent application 02 02631 filed Mar. 1, 2002, the disclosures of which are incorporated herein by reference in their entirety.

BACKGROUND

The invention relates to an electromagnetic actuator, and finds particular use in direct current (DC) electromagnetic actuators for actuating engine valves.

Electromagnetic actuators are known that comprise an actuator rod connected to an armature to form a moving assembly associated with a drive member that propels the moving assembly from one extreme position to another, the extreme positions corresponding to the valve being in its open and closed positions.

The drive member comprises at least one coil fitted with a core, one face of the armature being adapted to come into contact with one face of the coil core when the valve is in one of its open or closed positions. The coil serves to move the armature and to retain it so as to hold the moving assembly in the corresponding extreme position. For this purpose, the coil is connected to a DC power supply circuit.

While the actuator is in operation, the coil is powered, thereby creating magnetic flux which is looped via the armature. The coil thus exerts a force of attraction on the armature.

While the armature is still far away from the core of the coil, the total air gap through which the flux needs to pass between the armature and the core is large. The coil then needs to be fed with high current in order to ensure that the force of attraction it develops overcomes the opposing forces to which the moving assembly is subject.

However, as the armature comes close to the core, the total air gap between the armature and the core decreases very quickly, and the power supply electronics is generally not fast enough to reduce the magnitude of the current it is delivering in proportion to the rate at which the air gap is closing.

The attraction force exerted by the coil on the armature at the end of its stroke greatly exceeds the opposing force acting on the moving assembly. The armature thus strikes the core at high speed, thereby producing an undesirable clattering noise, and preventing proper control over the docking speed of the valve against its seat in the closed position.

Attempts have been made to reduce the force of attraction at the end of the stroke by limiting the intensity of the flux that can be established in the armature.

Unfortunately, the armature is generally dimensioned so as to operate at the magnetic saturation limit that corresponds to the maximum flux the coil can develop, as occurs when the armature is remote from the core. Limiting flux does indeed make it possible to reduce the force of attraction at the end of the stroke, but it degrades the performance of the actuator when the armature is remote from the core.

The description below seeks to propose means for adapting the force of attraction of the coil on the armature at the end of its stroke, preferably without degrading the performance of the object of the actuator when the armature is remote from the core.

BRIEF SUMMARY

To this end, in one embodiment there is provided an electromagnetic actuator comprising an actuator member connected to an armature which is movable under drive from a drive member comprising at least one coil for generating magnetic flux in a core having a face facing a face of the armature, at least one of the facing faces including at least one set-back portion, where the armature and the core are arranged, in a first zone of the armature and of the core including the set-back portion, to define a first magnetic path which is interrupted by an air gap that is not less than the setback of the set-back portion when the armature bears against the core, and in a second zone of the armature and of the core excluding the set-back portion, to define a second magnetic path which is interrupted solely by a residual air gap when the armature bears against the core, the total area of the set-back portion being no greater than an area that would bring the magnetic flux to saturation in the second zone of the armature.

Thus, when the face of the armature is remote from the face of the core at a distance which is large compared with the setback of the set-back portion, the value of the flux in the core is determined mainly by the distance between the armature and the core, such that the set-back portion has only negligible influence on the performance of the actuator. When the armature comes close to the core, the setback of the set-back portion becomes large compared with the residual space that remains between the facing faces. The total air gap that the flux needs to cross in the first zone is thus increased. For given current, the force of attraction exerted by the coil on the armature is thus decreased.

Thus, for power supply electronics having the same feed, this embodiment tends to make it possible to reduce the force of attraction at the end of a stroke, such that the armature may come against the core more slowly and the clattering noise may be eliminated. This embodiment thus may make it possible to increase the extent to which the force of attraction is varied for a given variation in current.

It should be observed that the presence of set-back portions tends to lead to a corresponding increase in the holding current needed for holding the armature against the core. By acting on the relative areas of the first and second zones, it is thus possible to achieve a compromise between the looked-for reduction in force at the end of a stroke and the corresponding increase in current for holding the armature against the core.

In this respect, it is generally beneficial to ensure that the magnetic flux in the second zone does not exceed a saturation value, since that would degrade the performance of the actuator.

For an actuator in which the core comprises a central branch and two side branches having ends that define the face of the core, the set-back portion advantageously extends over the face of the armature that faces at least one of the branches of the core.

In one embodiment, the armature has set-back portions, each extending facing one of the side branches of the core, preferably symmetrically relative to the actuator member.

Preferably, the set-back portion extends transversely beyond the facing branch by a distance that is not less than the setback of the set-back portion relative to the face of the armature.

In another embodiment, the set-back portion extends across all three branches, facing each of them.

According to some embodiments, the first zone and the second zone are magnetically isolated.

This disposition avoids flux migrating into the second zone where it could become established more easily, thereby reducing the effectiveness of the set-back portions.

The core is preferably made up of a stack of laminations, and may include at least one magnetic barrier being inserted in the stack of laminations in order to separate the laminations constituting the first zone from the laminations constituting the second zone of the core.

BRIEF DESCRIPTION OF THE DRAWINGS

Other characteristics and advantages of the invention appear more clearly in the light of the following description of particular, non-limiting exemplary embodiments. Reference is made to the accompanying figures, in which.

The figures are not to scale in order to make the invention easier to understand.

DETAILED DESCRIPTION OF EXEMPLARY EMBODIMENTS

Figure 1A:
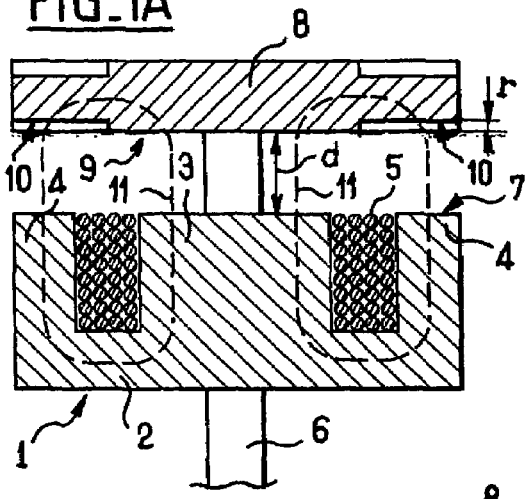
FIG. 1A is a diagrammatic section view on plane IA of FIG. 2A showing an actuator in which the armature is shown remote from the core.
Figure 1B:
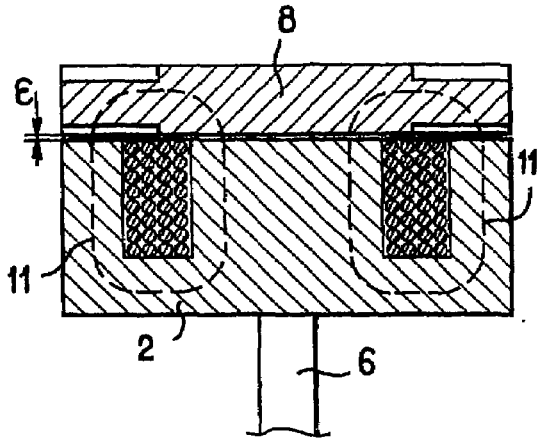
FIG. 1B is a diagrammatic section view on plane IV of FIG. 2B in which the armature is shown in contact with the core.

With reference to FIGS. 1A and 1B, the actuator shown comprises, in conventional manner, two coils placed facing each other. Only one coil 1 is shown in order to keep the drawing uncluttered. The coil 1 has a core 2 presenting a central branch 3 and two side branches 4. A conductor 5, whose turns can be seen in section, is wound around the central branch 3 of the core 2. An actuator rod 6 is slidably mounted in a bore of the central branch 3 to move in a direction perpendicular to a face 7 of the core 2 defined by the ends of the central branch 3 and the side branches 4. The actuator rod 6 is secured to armature 8 which possesses a face 9 parallel to the face 7 of the core 2, and which is constrained to move between the coils.

An electronic DC power supply (not shown) feeds DC to the conductor 5 in order to establish flux 11 between the core 2 and the armature 8 in order to exert a force of attraction on the armature 8. The magnetic flux 11 circulates through the core 2 via the central branch 3 and each of the side branches 4. The magnetic flux 11 is looped in the armature 8, crossing a total air gap equal to the space between the armature 8 and the core 2 facing the central branch 3, plus the space between the armature 8 and the core 2 facing each side branch 4.

In the first embodiment of the invention, each of the faces of the armature 8 presents four adaptation portions 10 each set back by a set-back distance r from the face that includes the set-back portion 10 in question. Each of the set-back portions 10 lies facing one of the side branches 4 of the core 2, and the set-back portions are disposed symmetrically about the actuator rod 6.

In the figures, the set-back portions 10 are shown on both faces of the armature 8 since the armature 8 co-operates in like manner with another coil (not shown) which extends facing the other face of the armature 8. For the purposes of description, only the set-back portions 10 made in the face 9 facing the core are taken into consideration.

In the position shown in FIG. 1A, the armature 8 is remote from the core 2, and the setback r of the set-back portion 10 is negligible compared with the distance d and measured between the face 9 of the armature 8 and the face 7 of the core 2. The total air gap to be crossed by the flux is thus substantially equal to twice the distance d, with the presence of the set-back portions 10 having negligible influence.

By way of example, the setback r is about 0.2 millimeters (mm), for a maximum distance d of about 8 mm.

The force of attraction exerted by the coil 1 is therefore not disturbed by the presence of the set-back portions 10 while the armature 8 is still remote from the core 2.

In the position shown in FIG. 1B, the face 9 of the armature 8 and the face 7 of the core 2 are in contact. Because of surface defects, on the core and on the armature, a residual space $\epsilon$ still remains between the two faces, which residual space is much smaller than the setback of the set-back portions 10. The total air gap to be crossed by the flux is thus substantially equal to the set-back distance r facing the set-back portions 10, whereas otherwise, in the absence of the set-back portions 10, it would have been equal to twice the residual space $\epsilon$.

For given current, the force of attraction exerted by the coil 1 on the armature 8 varies inversely with the square of the air gap. When the armature comes close to the core 2, the force of attraction is thus decreased very significantly facing the set-back portions, such that for a given speed of current reduction, the invention makes it possible to reduce the speed of the armature more quickly as it docks against the core. In addition to the additional air gap, the set-back portions also reduce the inductive effect of the armature on the coil 1, thereby improving the speed with which current in the coil can be reduced.

Figure 2A:
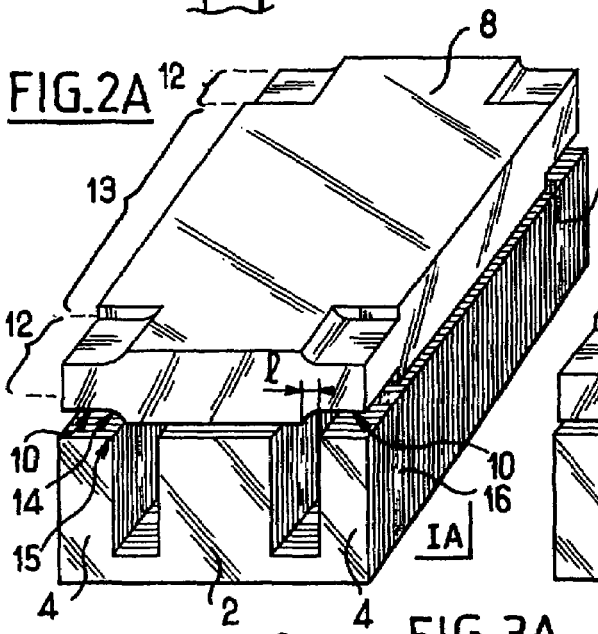
FIG. 2A is a fragmentary perspective view of a first embodiment in which the armature is shown remote from the core, and in which the conductor of the coil has been omitted.
Figure 2B:
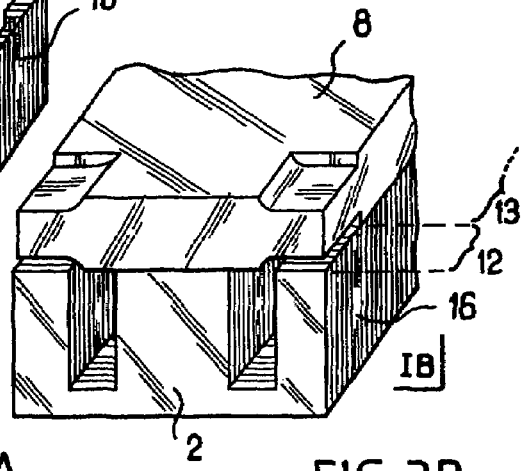
FIG. 2B is a fragmentary view analogous to FIG. 2A, in which the armature is shown in contact with the core.

In the first embodiment of the invention as shown in FIGS. 2A and 2B, the set-back portions 10 do not occupy the entire length of the side branches 4, but only a fraction thereof.

The set-back portions 10 define the longitudinal ends of a first zone 12 of the armature 8 and of the core 2 in which the total air gap to be crossed by the flux is substantially equal to the setback r of the set-back portions 10, and a second zone 13 of the armature 8 and of the core 2 in which the total air gap is equal to twice the residual space $\epsilon$ between the faces 7 and 9.

It should be observed that after the armature has been put into contact against the core, holding the armature against the core then requires the coil to be fed with a holding current, and the greater the setback r and the greater the areas of the set-back portions, the greater the magnitude of the holding current. The area given to the set-back portions is thus the result of a compromise between the looked-for force reduction in order to increase the variation in the force of attraction, and a reasonable increase in the holding current. In practice, it has been found that for a set-back distance equal to 0.2 mm, set-back portions having an area equal to one-third of the area of the side branches of the core provides a satisfactory compromise.

By modifying the relative lengths of the zones 12 and 13, it is possible to modulate the weakening of the force of attraction at the end of the stroke. Nevertheless, this modulation is limited by the fact that an excessive increase in the areas of the set-back portions would run the risk of saturating the second zone 13.

Such saturation would lead to degraded performance of the actuator.

In practice, the total area of the set-back portions should be limited to 50% of the total area of the facing faces of the armature and the core.

According to some embodiments, the set-back portions 10 extend transversely beyond the facing side branches by a distance l that is not less than the setback r of the set-back portion. In the example shown, the set-back portions 10 are defined transversely by fillets 14 of radius equal to the setback r of the set-back portions 10, with the center of the fillet 14 being situated substantially at the internal edge 15 of the side branch 4 when the armature 8 is in contact with the core 2.

This disposition minimizes the passage of flux towards the zone 13 in the vicinity of the internal edge 15 over a distance to be crossed that is smaller than the set-back distance of the set-back portions, since that would decrease the effectiveness of the set-back portions 10.

Furthermore, the core 2 is advantageously made up of a stack of cutout laminations so as to limit longitudinal migration of flux. This disposition counters any tendency of the flux that should normally be established in the zone 12 to migrate towards the zone 13 where the total air gap is smaller. In order to further limit this migration, a magnetic barrier 16, e.g. a piece of non-magnetic material having the same shape as the laminations forming the core, can be inserted in the stack of laminations in order to isolate the portion of the core corresponding to the zone 12 magnetically from the portion of the core corresponding to the zone 13.

Figure 3A:
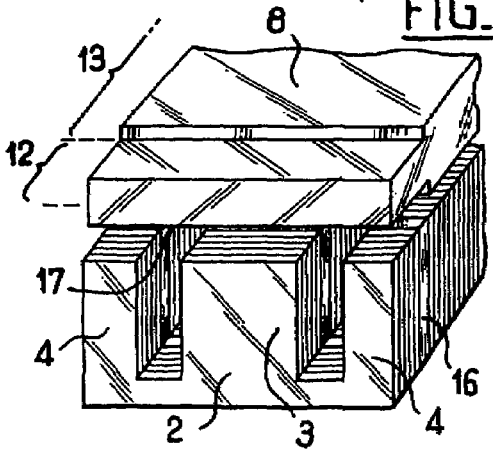
FIG. 3A is a fragmentary perspective view of a second embodiment in which the armature is shown remote from the core, and in which the conductor of the coil has been omitted.
Figure 3B:
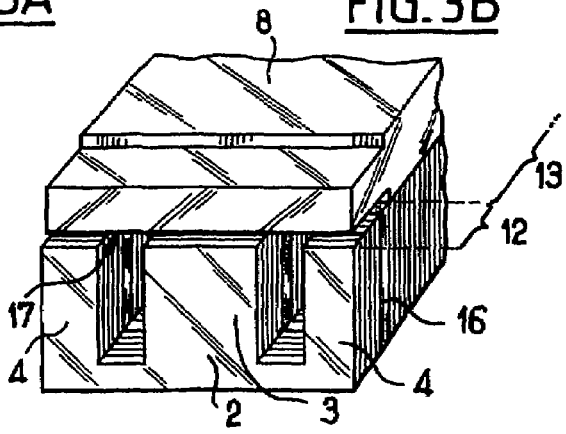
FIG. 3B is a view analogous to FIG. 3A in which the armature is shown in contact with the core.

In a second embodiment as shown in FIGS. 3A and 3B, the set-back portions are formed by steps 17 which extend transversely facing the central branch 3 and the side branches 4 of the core 2. In this case, the setback of the set-back portion has an effect on the flux not only where it passes between a side branch and the armature, but also where it passes between the central branch and the armature.

A step 17 is easier to machine than the set-back portions 10 shown in FIGS. 2A and 2B, and it avoids any risk of magnetic flux passing in unwanted manner via the internal edges 15 of the side branches 4.

The step 17 defines two zones 12 and 13 in the same manner as in the above embodiment. In the zone 12 corresponding to the step 17 and in order to be looped, the flux needs to cross the setback r of the step 17 once in the air gap corresponding to the central branch 3 and once again in the air gap with one or other of the side branches. For a reduction in the force of attraction that is the same as in the first embodiment, it therefore suffices for the setback r of the step 17 to be equal to half the set-back distance of the set-back portions 10.

Figure 4:
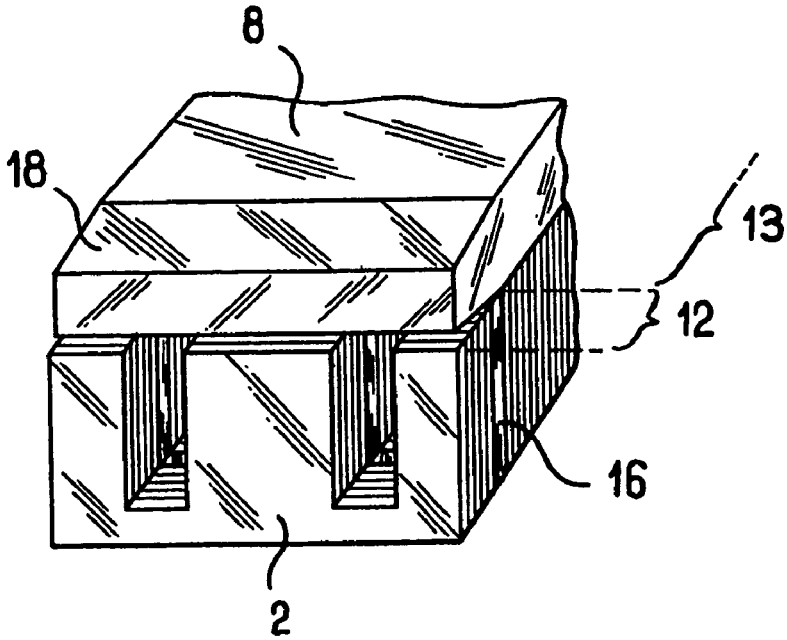
FIG. 4 is a fragmentary perspective view of an actuator constituting a variant of the second embodiment.

In a variant of this embodiment, shown in FIG. 4, the step 17 is replaced by a chamfer 18. The distance between the face 7 of the core 2 and the chamfer 18 is not constant, but increases with increasing distance from the center of the armature 8. The chamfer 18 has the same effect as the step 17, but it makes it possible to avoid undesirable edge effects that might otherwise occur along the edge of the step 17.

Figure 5:
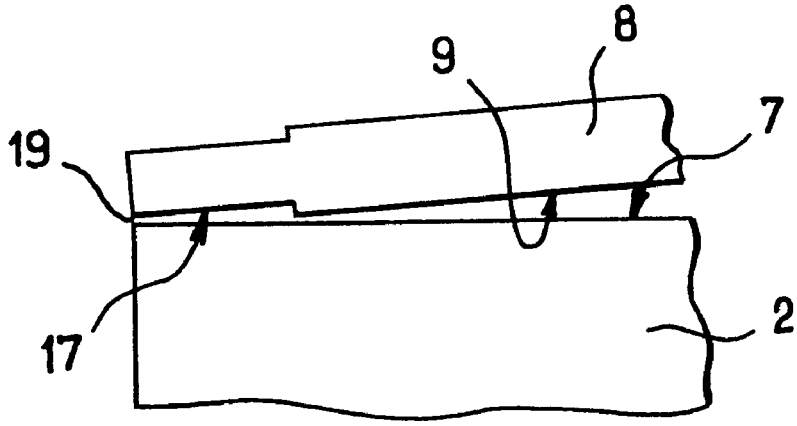
FIG. 5 is a diagrammatic side view of the actuator shown in FIGS. 3A and 3B.

FIG. 5 shows, in exaggerated manner, a position that the armature 8 having a step 17 can take up relative to the core 2, given assembly clearances in the actuator. It can be seen that the distance between the face 7 of the core 2 and the bottom of the step 17 decreases going towards the end of the armature 8, so that magnetic flux will tend to concentrate in the vicinity of the end edge 19 of the armature 8, thereby decreasing the performance of the actuator.

Figure 6:
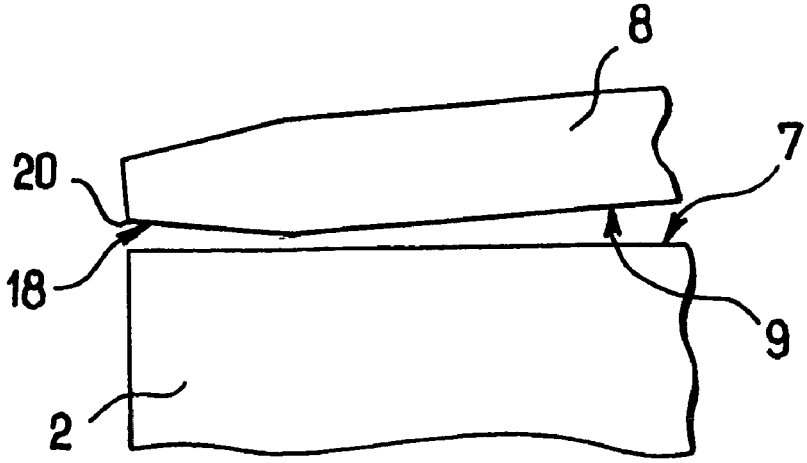
FIG. 6 is a diagrammatic side view of the actuator shown in FIG. 4.

FIG. 6 shows an armature 8 having a chamfer 18 in the same configuration as in FIG. 5. It can be seen that the distance between the face 7 of the core 2 and the chamfer 18 continues to increase towards the end of the armature, so the risk of magnetic flux becoming concentrated on the end edge 20 of the armature 8 is thus avoided.

This risk of unbalance in the positioning of the armature is further minimized by the set-back portions being disposed symmetrically about the actuator member 6.

The invention is not limited to the particular embodiments described above, but on the contrary extends to cover any variant that comes within the ambit of the invention as defined by the claims.

Although the set-back portions are shown in the form of a step or a chamfer, the set-back portions could more generally take any shape suitable for providing space between the set-back portions and the facing faces when the two faces are in contact, e.g. a series of grooves.

Although the invention is shown with the set-back portions made in the armature, the set-back portions could equally well be made in the face of the core, or simultaneously in the armature and in the core, although that solution would appear a priori to be more complex to implement than in the set-back portions in the armature.

Although the faces of the armature and the core are shown as being plane, the faces could take on any complementary shapes suitable for enabling them to come into contact away from the set-back portions.

Although it is stated that the set-back portions are defined transversely by a fillet, the transverse portions could be defined by any other shape providing the set-back portions extend transversely beyond the facing side branch by a distance that is not less than the set-back distance.

Although it is stated that the set-back portions extend facing the side branches, or astride the central branch and the side branches, it would also be possible to provide set-back portions extending facing the central branch only.

Although the invention is described in the context of an actuator having two coils, it applies equally to an actuator having a single coil with a core having active ends facing both faces of the armature.

The invention claimed is:

1. An electromagnetic actuator comprising:

an actuator member connected to an armature which is movable under drive from a drive member comprising at least one coil for generating magnetic flux in a core having a face facing a face of the armature, at least one of the facing faces including at least one set-back portion, wherein the armature and the core are arranged, in a first zone of the armature and of the core including the set-back portion, to define a first magnetic path which is interrupted by an air gap that is not less than the setback of the set-back portion when the armature bears against the core, and in a second zone of the armature and of the core excluding the set-back portion, to define a second magnetic path which is interrupted solely by a residual air gap when the armature bears against the core, and wherein the total area of the set-back portion is no greater than an area that would bring the magnetic flux to saturation in the second zone of the armature.

2. An electromagnetic actuator according to claim 1, wherein the total area of the set-back portion is less than 50% of the total area of the facing faces.

3. An electromagnetic actuator according to claim 1, wherein the core comprises a central branch and two side branches having ends which define the face of the core, and the set-back portion extends over the face of the armature facing at least one of the branches of the core.

4. An electromagnetic actuator according to claim 3, wherein the armature has set-back portions which extend facing the side branches of the core.

5. An electromagnetic actuator according to claim 3, wherein the set-back portions are symmetrical relative to the actuator member.

6. An electromagnetic actuator according to claim 3, wherein the set-back portion extends transversely beyond the facing branch over a distance that is less than the setback of the set-back portion relative to the actuator member.

7. An electromagnetic actuator according to claim 3, wherein the set-back portion extends transversely relative to all three branches, facing each of them.

8. An electromagnetic actuator according to claim 7, wherein the set-back portion is in the form of a chamfer.

9. An electromagnetic actuator according to claim 1, wherein the first zone and the second zone of the core are magnetically isolated from each other.

10. An electromagnetic actuator according to claim 9, wherein the core is made up of a stack of laminations, at least one magnetic barrier being inserted in the stack of laminations, to separate the laminations making up the first and second zones of the core.

11. An actuator comprising:

an electromagnet comprising a coil and a core, the core comprising a first face;

an armature having a second face that faces the first face;

wherein the armature and core are configured such that, a first magnetic path is defined in a first zone, which first magnetic path is interrupted by an air gap having a first size when the armature is in an extreme position, and a second magnetic path is defined in a second zone, which second magnetic path is interrupted by an air gap having a second size when the armature is in the extreme position, the second size being less than the first size;

wherein the core comprises a magnetic barrier that separates the first zone from the second zone.

12. The actuator of claim 11, wherein the armature and core are configured such that a third magnetic path is defined in a third zone, which third magnetic path is interrupted by an air gap having a third size when the armature is in the extreme position, the third size being equal to the first size.

13. The actuator of claim 12, further comprising a magnetic barrier that separates the second zone from the third zone.

14. The actuator of claim 11, wherein the first zone comprises a set-back, and the total area of the set-back portion is no greater than an area that would bring the magnetic flux to saturation in the second zone of the armature.

15. The actuator of claim 11, wherein armature comprises a chamfer in the first zone, which chamfer contributes to the first size of the air gap of the first zone.

16. The actuator of claim 11, wherein at least one of the armature and the core comprises a set-back portion and the first size is not less than a size of a setback of the set-back portion.

17. The actuator of claim 11, wherein the actuator is configured to cause movement of the armature in a first direction using a coil and is configured to cause movement of the armature in a second direction using the coil.

18. The actuator of claim 11, wherein the actuator is configured to cause movement of the armature in a first direction using a first coil and is configured to cause movement of the armature in a second direction using a second coil.

19. An engine comprising:

an armature which is movable by an electromagnet comprising at least one coil for generating magnetic flux in a core having a face facing a face of the armature, at least one of the facing faces including at least one set-back portion, the armature and the core arranged such that, a first magnetic path is defined in a first zone of the armature and of the core, the first zone including the set-back portion and the first magnetic path being interrupted by an air gap that is not less than a setback of the set-back portion when the armature bears against the core, and a second magnetic path is defined in a second zone of the armature and of the core, the second zone excluding the set-back portion and the first magnetic path being interrupted by no more than a residual air gap when the armature bears against the core; and a valve coupled to the armature such that movement of the valve can be controlled by movement of the armature;

wherein the first zone and the second zone of the core are magnetically isolated from each other.

20. The engine of claim 19, wherein the total area of the set-back portion is less than 50% of the total area of the facing faces of the armature and the core.

21. The engine of claim 19, wherein the core comprises a central branch and two side branches having ends which define the face of the core that face the armature, and the set-back portion extends over a portion of the face of the armature facing at least one of the branches of the core.

22. The engine of claim 21, wherein the set-back portion extends transversely beyond the branch it faces over a distance that is less than a setback of the set-back portion relative to the actuator member.

23. The engine of claim 19, wherein the set-back portion is in a form of a chamfer.

24. An electromagnetic actuator according to claim 1, wherein the core comprises a side branch and a central branch;

the set-back of the first zone faces at least the side branch; and the second zone faces at least the side branch.

25. An electromagnetic actuator according to claim 1, wherein the core comprises at least three branches;

the set-back of the first zone faces the three branches.

26. An electromagnetic actuator according to claim 1, wherein the first zone comprises four adaptation portions.

27. An electromagnetic actuator according to claim 1, wherein the set-back portion is set back about 0.2 mm.

28. An electromagnetic actuator according to claim 1, wherein:

the core comprises a side branch and a central branch;

the set-back portion faces at least the side branch; and the set-back portion does not occupy an entire length of the side branch.

29. An electromagnetic actuator according to claim 1, wherein the core comprises side branches and a central branch;

the set-back portion faces at least the side branches; and the set-back portion occupies about one-third of the area of the side branches.

30. An electromagnetic actuator according to claim 1, wherein the size of the set-back portions of the first zone are selected such that they avoid saturating the second zone.

31. An electromagnetic actuator according to claim 1, wherein the set-back portion has a size no more than 50% of the total area of the facing faces of the armature and core.

32. An electromagnetic actuator according to claim 1, wherein the set-back faces the central branch.

33. An electromagnetic actuator according to claim 32, wherein the set-back only faces the central branch.

34. An electromagnetic actuator comprising:

an actuator member connected to an armature which is movable under drive from a drive member comprising at least one coil for generating magnetic flux in a core having a branch, the branch having a face facing a face of the armature, at least one of the facing faces including at least one set-back portion, wherein the armature and the core are arranged, in a first zone of the armature and of the core including the set-back portion facing the branch, and in a second zone of the armature and of the core excluding the set-back portion, to define a second magnetic path which is not interrupted by the set-back portion, and wherein the set-back portion does not occupy the entire length of the branch.

35. The actuator of claim 34, wherein the branch is a side branch and the core further comprises a central branch.

36. The actuator of claim 34, wherein the set-back portion is in the form of a chamfer.

37. An electromagnetic actuator comprising:

an actuator member connected to an armature which is movable under drive from a drive member comprising at least one coil for generating magnetic flux in a core having a face facing a face of the armature, at least one of the facing faces including at least one set-back portion, wherein the armature and the core are arranged, in a first zone of the armature and of the core including the set-back portion, and in a second zone of the armature and of the core excluding the set-back portion, to define a second magnetic path which is not interrupted by the set-back portion, and wherein the set-back occupies no more than 50% of the total area of the facing faces of the armature and the core.

38. The actuator of claim 37, wherein:

the core comprises at least three branches; and the set-back of the first zone faces the three branches.

39. The actuator of claim 38, wherein the set-back portion does not occupy the entire length of a side branch of the three branches.

40. The actuator of claim 37, wherein the set-back portion is in the form of a chamfer.

* * * * *